US005720879A

United States Patent [19]

Cope

[11] Patent Number: 5,720,879

[45] Date of Patent: Feb. 24, 1998

[54] HORIZONTAL CENTRIFUGAL SEPARATOR WITH ANGULATED VANES

[75] Inventor: Dewey M. Cope, St. Louis, Mo.

[73] Assignee: Elgin National Industries, Inc., Downers Grove, Ill.

[21] Appl. No.: 598,244

[22] Filed: Feb. 8, 1996

[51] Int. Cl.[6] ..... B04B 1/08; B04B 1/12

[52] U.S. Cl. ..... 210/369; 210/380.3; 210/377; 210/380.2; 494/36; 494/43; 494/60

[58] Field of Search ..... 210/360.1, 369, 210/380.3, 382, 377; 494/15, 36, 43, 60

[56] References Cited

U.S. PATENT DOCUMENTS 3,279,611 10/1966 Rotel ..... 210/380.3
4,135,659 1/1979 Derton et al. .
4,900,442 2/1990 Connolly et al. .

*Primary Examiner*—David A. Reifsnyder
*Attorney, Agent, or Firm*—Paul M. Denk

[57] ABSTRACT

In a horizontal centrifugal apparatus for separating wetting material carried on chips, such apparatus includes a conically shaped bowl carrying vanes distributed about its inner face with the midpoint of the length of said vane lying on a radius from the horizontal axis of bowl rotation such that the vane leading ends and trailing ends are about fifteen degrees of the radius at the midpoint of such vanes to impose an impediment to the rate of erosion on the vanes.

1 Claim, 2 Drawing Sheets

HORIZONTAL CENTRIFUGAL SEPARATOR WITH ANGULATED VANES

BACKGROUND OF THE INVENTION

This invention relates generally to centrifugal separation of granular material, shredded material, or other particulates such as coal, scrap, and the like, from the wash water, or conveying fluids, or other liquid material, and more specifically, to improvements in the durability of the components of the centrifugal separator as affected by the centrifugal action in separating such material from their fluids.

Various types of centrifugal separating apparatuses are represented in the prior art. The prior art apparatuses are usually constructed for distributing the liquid wetted granulated material, the crushed material, chips, into the centrifugal separator without regard to the abrading effect the moistened particulate may have on the separating apparatus. This is especially true when the material of the particulate matter approaches the same characteristics as the material or components employed in a separator apparatus. For example, shredded or crushed metal components, such as the type normally fed through a crusher, may be formed of metal similar to that from which the components of the centrifugal separator are fabricated. When the particulate matter has that characteristic, its abrading action upon select components of the separating apparatus can be very destructive on the apparatus, particularly when it operates over a period of time, with the frictional forces involved leading towards, in some instances, a rather prompt erosion of the component structure, which can lead towards an eventual breakdown of the centrifugal separating apparatus. As a result, expensive parts to the separator must be replaced, due to their shortened life, which can effect the overall useful life of the components and the separating apparatus itself, raise the cost of its maintenance, which may not have been anticipated in its life span and accounting when the apparatus was originally obtained.

The most relevant prior art known is the Derton, et al U.S. Pat. No. 4,135,659, and also the Connally et al U.S. Pat. No. 4,900,442.

It is, therefore, the principal object of this invention to provide means to extend the useful life of select components of a centrifugal separator, in order to reduce the installation expense, maintenance of the apparatus over its life span, to sustain the equipment for a more useful life.

SUMMARY OF THE INVENTION

The primary object of this invention is to provide a centrifugal separator wherein its materials holding vanes that sustain the particulate during functioning of the centrifuge have a designed orientation that provides a better hold to the incoming particulate material, and thereby reduce the incidence of frictional abrasion inherent in the prior art designed apparatuses.

A further object of this invention is to extend the useful service life of a centrifugal separator apparatus, especially in situations where the wetted separated material may be especially abrasive upon the component structure when subjected to the velocities encountered in the operations of the centrifugal separator.

These and other objects will become more apparent to those skilled in the art upon review of the summary herein, and the description of the preferred embodiment as shown in its drawings.

BRIEF DESCRIPTION OF THE DRAWINGS

The embodiment best representative of the invention is seen in.

DESCRIPTION OF THE PREFERRED EMBODIMENT

Figure 1:
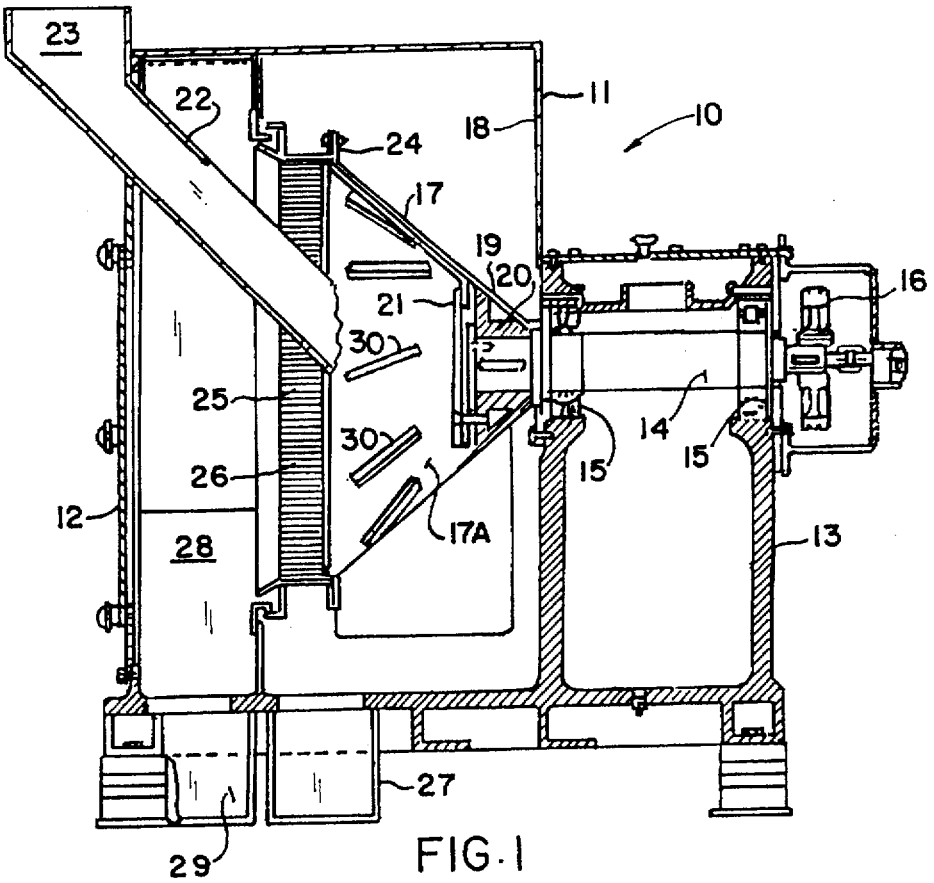
FIG. 1 provides a sectional elevation of a centrifugal separator showing the various components therein.
Figure 2:
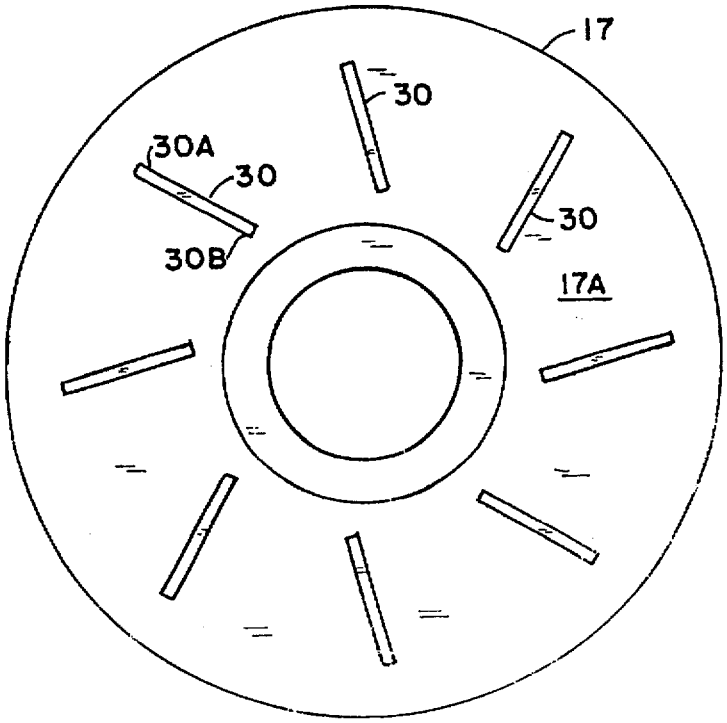
FIG. 2 provides an end view of a centrifugal deflector bowl for the apparatus of FIG. 1.

Referring to FIGS. 1 and 2, the centrifgual separator 10 comprises a housing enclosure 11 having a removal cover 12 to afford access to the interior of the housing when needed. The housing 11 has an adjacent support structure 13 for a rotary shaft 14 carried in suitable bearings 15. The shaft is connected to a pulley 16 driven by a suitable belt drive not necessary to show. That drive is selected to be able to meet the speed of roation of shaft 14 to give a desired rotary speed to a revolving centrifugal bowl or screen 17 in the chamber 18 in housing 11. The bowl is in the shape of a cone attached at its base 19 to the forward end 20 of the shaft 14 that extends into the chamber 18. The bowl 17 encloses a plate 21 on which the chips or particulate material impinges during feeding the wetted chips through the chute 22 from the hopper 23.

As seen in FIG. 1, the conic bowl 17 has an enlarged diameter run 24 which offers support for a liquid-particulate separator screen 25. That screen allows oils and other liquids to pass through. The screen is composed of rods 26 arranged to have sufficient spacing to allow for the passage of the liquid material which is centrifuged and drained off and collected in a bin 27, by way of the centrifugal action of the separator. During the rotation of the bowl 17, the chips are forced to pass along the screen 26 giving up its liquid material, and are collected in the space 28 for the passage into a bin 29.

It is seen that the inner surface 17A of the bowl 17 carries a plurality of near radially mounted vanes 30 (See FIGS. 2 and 3) which present impact surfaces and collection points for chips and which eventually forcibly directs the chips to slide along the bowl surface 17A while traveling outwardly, and to pass along the screen 25 and for collection in space 28. The vanes 30 have leading ends 30A and trailing ends 30B so that the lead vanes 30A are oriented to move ahead of their trailing ends.

Figure 3:
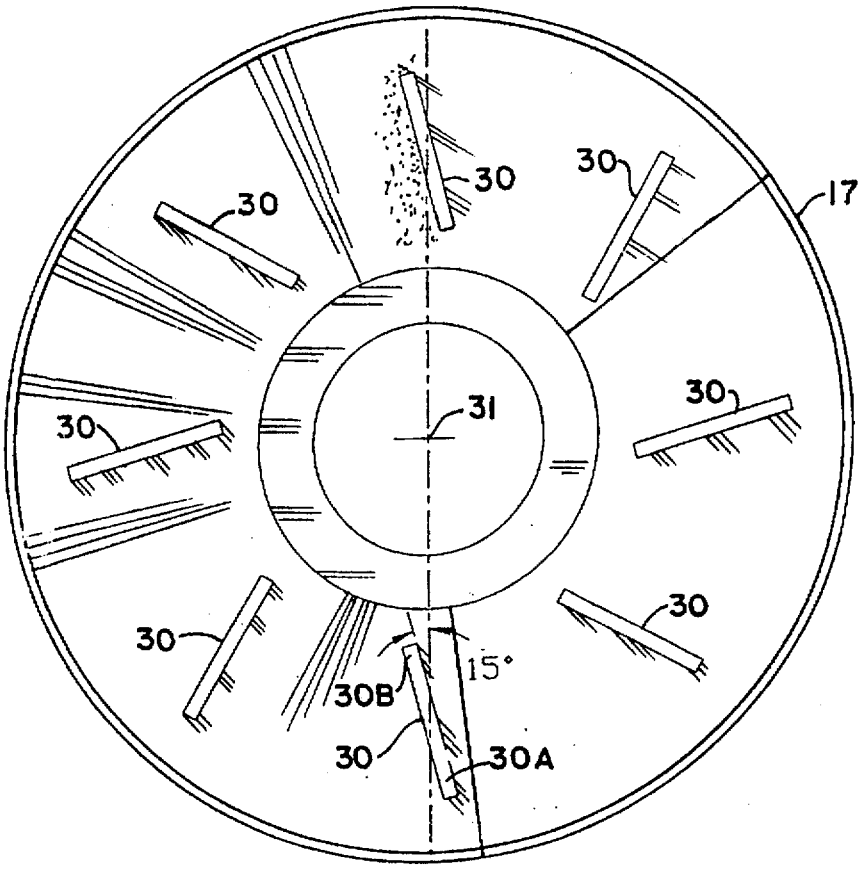
FIG. 3 is an end view of the centrifugal bowl to illustrate diagrammatically the deflector elements orientation.
Figure 4:
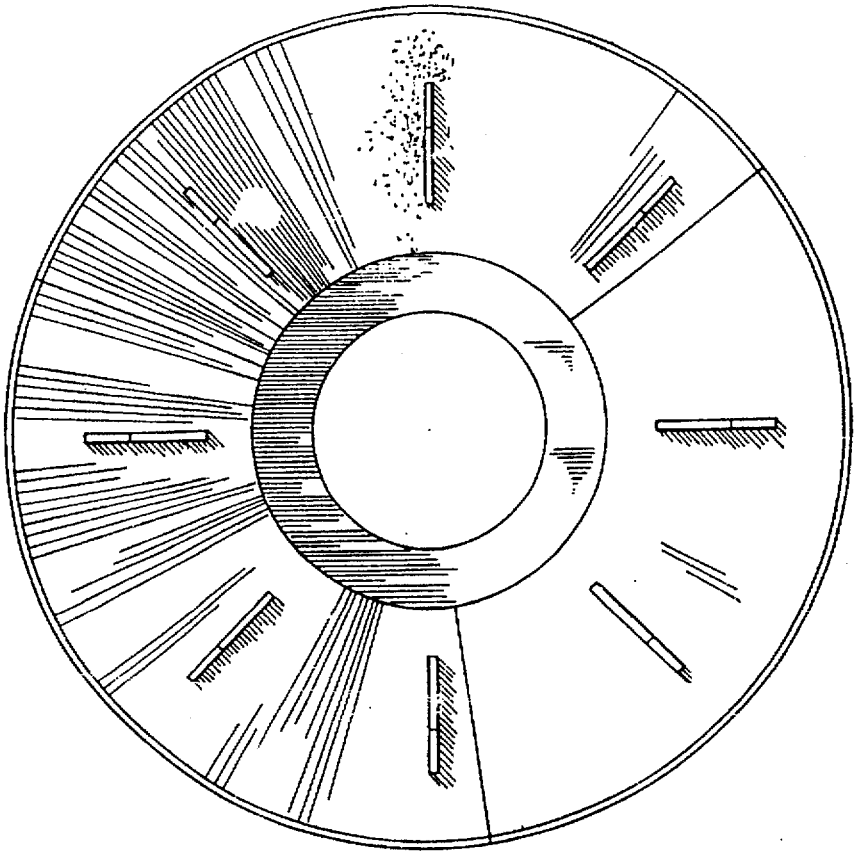
FIG. 4 PRIOR ART
FIG. 4 is a view of a prior art, centrifugal separator component in the apparatus seen in FIG. 1

The improvement in this apparatus is best illustrated in FIG. 3 to show the action of the vanes 30. In this illustration, the rotation of the bowl 17 is counter clockwise about the axis 31 of the shaft 14. Thus, each vane has an angular orientation about the middle of its length (see FIG. 3) which is on a radius from the horizontal axis 31, whereby the leading end 30A of each vane is approximately 15° ahead of the midpoint and the trailing end is about 15° behind the midpoint. This angular orientation of vanes forces the chips to impinge along and be temporarily retained along the full length of each vane 30. Hence, the chips are retained and slowly slide outwardly so that the wear on the vanes 30 is reduced and distributed more evenly, when compared to the way the chips of FIG. 4 can wear principally at the outer end of edges of the vanes. As these newly oriented vanes are eroded in the manner indicated, as gradually along the length of each vane where its integrally connects with the interior surface of the screen, the efficiency of the centrifugal separation is enhanced whereas the productivity of the FIG. 4 type of appartus is diminished.

Having described the invention, what is claimed is:

1. A centrifugal separating apparatus for centrifugally separating liquid wetting on chip or particulate material from the respective materials, said apparatus comprising:

(a) conic shaped bowl having a base end at the small diameter and a flared larger diameter at an opposite outlet end;

(b) means connected to said base end to rotate said bowl about a horizontal axis; and (c) vane elements secured interiorly in said conic bowl and distributed evenly around said bowl, said vane elements having a lengthwise dimension arranged at an angle to the radial axis of rotation whereby said angle causes said vane elements to lean into the direction of rotation of said bowl, said vane elements carried in said conic bowl having a length the midpoint of which is oriented to lie on a radius from the horizontal axis of rotation of said conic cowl, said vane elements having leading ends ahead of said midpoint in the direction of rotation and trailing ends behind said midpoint in the direction of rotation of said horizontal axis, said vane elements leading end is about 15° ahead of the midpoint, and said vane elements trailing end is about 15° behind said midpoint with said midpoint being on a radius from the horizontal axis of rotation.

* * * * *

UNITED STATES PATENT AND TRADEMARK OFFICE

CERTIFICATE OF CORRECTION

PATENT NO. : 5,720,879

DATED : February 24, 1998

INVENTOR(S) : Dewey M. Cope

It is certified that error appears in the above-indentified patent and that said Letters Patent is hereby corrected as shown below:

Column 4, claim 1, line 7, change "cowl" to ---bowl---.

Signed and Sealed this

Fifth Day of May, 1998

Bruce Lehman

*Attest:*

BRUCE LEHMAN

*Attesting Officer*

*Commissioner of Patents and Trademarks*